US005552560A

United States Patent [19]

Ura

[11] Patent Number: 5,552,560

[45] Date of Patent: Sep. 3, 1996

[54] ELECTRONIC KEYBOARD MUSICAL INSTRUMENT WITH MULTIFUNCTIONAL KEYBOARD

[75] Inventor: Tomoyuki Ura, Shizuoka-ken, Japan

[73] Assignee: Yamaha Corporation, Japan

[21] Appl. No.: 310,658

[22] Filed: Sep. 22, 1994

[30] Foreign Application Priority Data

Sep. 29, 1993 [JP] Japan ..... 5-243212

[51] Int. Cl.[6] ..... G10H 1/053; G10H 1/18

[52] U.S. Cl. ..... 84/653; 84/662; 84/707; 84/DIG. 26

[58] Field of Search ..... 84/615–620, 626–633, 84/653–658, 662–665, 678–690, 701–711, DIG. 26

[56] References Cited

U.S. PATENT DOCUMENTS 4,586,417 5/1986 Kato et al. ..... 84/DIG. 26
4,628,789 12/1986 Fujimori ..... 84/DIG. 26
4,649,786 3/1987 Niinomi et al. ..... 84/705
4,966,051 10/1990 Tajima .
5,166,464 11/1992 Sakata et al. .
5,338,892 8/1994 Sekine et al. ..... 84/DIG. 26

FOREIGN PATENT DOCUMENTS

0437289A3 7/1991 European Pat. Off. .
0573963A2 12/1993 European Pat. Off. .

*Primary Examiner*—Stanley J. Witkowski
*Attorney, Agent, or Firm*—Graham & James LLP

[57] ABSTRACT

A keyboard musical instrument produces electronic sounds in synchronism with fingering on a keyboard, and a player can select an reverberation emvironment and a depth of reverberation through predetermined keys of the keyboard before the performance, thereby making an arrangement on a switch board simpler.

3 Claims, 10 Drawing Sheets

ELECTRONIC KEYBOARD MUSICAL INSTRUMENT WITH MULTIFUNCTIONAL KEYBOARD

FIELD OF THE INVENTION

This invention relates to an electronic keyboard musical instrument and, more particularly, to an electronic keyboard musical instrument having a multifunctional keyboard available for not only a performance but also control thereof.

DESCRIPTION OF THE RELATED ART

While a player is fingering on a keyboard of the electronic keyboard musical instrument, the electronic musical instrument electronically produces musical tones, and allows the player to perform a music score. Thus, the keyboard is used for designating the musical tones in a performance.

The electronic keyboard musical instrument is progressively being developed, and another function is assigned to the keyboard. The keyboard of an electronic keyboard instrument is available for a transposition. If a player depresses one of the keys respectively assigned the notes C1 to C5 and, then, manipulates the power switch, the electronic keyboard instrument reassigns the notes to the respective keys, and the player performs a transposed music without changing the fingering.

The keyboard of another electronic keyboard musical instrument is available for selection of a music in an automatic player mode. The electronic keyboard musical instrument have stored various music scores, and selectively reproduces the musics in the automatic player mode without fingering on the keyboard. The stored music scores are tied to predetermined keys of the keyboard. When a person wants to enjoy one of the musics in the automatic player mode, he or she depresses one of the predetermined keys and, then, powers the electronic keyboard musical instrument. The electronic keyboard musical instrument starts to reproduce the selected music.

However, the additional function of the keyboard only achieves a single purpose, and other purposes requires an additional switches.

SUMMARY OF THE INVENTION

It is therefore an important object of the present invention to provide an electronic musical instrument which has a multipurpose keyboard achieving more than one function except for a performance.

To accomplish the object, the present invention proposes to select a function through a combination of keys.

In accordance with the present invention, there is provided a keyboard musical instrument having at least a standard playing mode for producing electronic sounds and a setting mode for making a selection at least twice for the electronic sounds, comprising: a) a keyboard having a plurality of keys selectively depressed by a player, the plurality of keys having first keys and second keys; b) an electronic sound producing system detecting keys depressed by the player in the standard playing mode for producing the electronic sounds; c) an entry means for causing the keyboard musical instrument to enter into the setting mode; d) a first selecting means for discriminating at least one depressed first key from the first keys in the setting mode for making a first selection for the electronic sounds; e) a second selecting means for discriminating at least one depressed second key from the second keys in the setting mode for making a second selection for the electronic sounds; f) an exit means for causing the keyboard musical instrument to recover from the setting mode to the standard playing mode; and g) a modifying means responsive to the first and second selections for modifying the electronic sounds in the standard playing mode.

The first and second selections may be concurrently or sequentially made.

BRIEF DESCRIPTION OF THE DRAWINGS

The features and advantages of the electronic keyboard instrument according to the present invention will be more clearly understood from the following description taken in conjunction with the accompanying drawings in which.

DESCRIPTION OF THE PREFERRED EMBODIMENTS

First Embodiment

Figure 1:
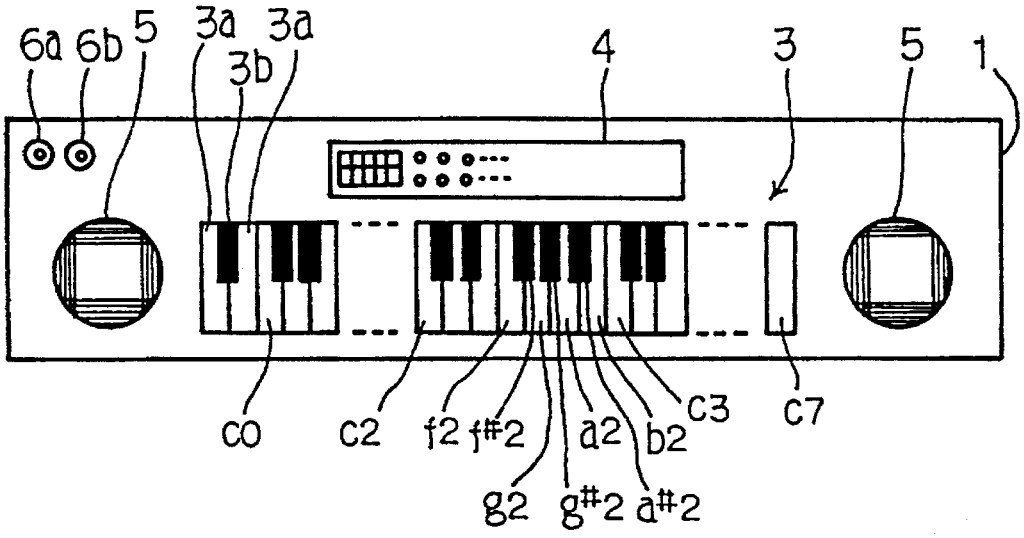
FIG. 1 is a front view showing an electronic keyboard musical instrument according to the present invention.

Referring first to FIG. 1 of the drawings, an electronic keyboard musical instrument embodying the present invention comprises a case 1 accommodating a circuit board 2 (see FIG. 2), a keyboard 3 arranged on a top surface of the case member 1, a switch board 4 also provided on the top surface and a speaker system 5 exposed to the top surface of the case member 1. Though not shown in FIG. 1, a headphone is insertable into a socket *6a*, and a person can listen to a music through the headphone instead of the speaker system 5. Another socket *6b* is also provided on the top surface of the case member 1, and is described hereinbelow in connection with the circuit board 2.

The electronic keyboard musical instrument selectively enters into a standard playing mode, a recording mode, an automatic playing mode and a setting mode associated with the standard playing mode and the automatic playing mode.

A plurality of black and white keys 3*a* and 3*b* form the keyboard 3, and are swingable with respect to the case member 1. Notes are assigned to the back and white keys 3*a* and 3*b*, and several keys 3*a* and 3*b* are labeled with the notes c0, c2, f2, f#2, g2, g#2, a2, a#2, b2, c3 and c7. The alphabetic letters c, f, g, a and b are indicative of the pitch names, and numerals 0, 2, 3 and 7 represent octaves.

All of the keys 3*a* and 3*b* are available for a performance in the standard playing mode, and a player sequentially designates the notes of the music tones through a fingering on the keyboard 3.

The white keys f2, g2, a2 and b2 and the black keys f#2, g#2 and a#2 are further used for controlling reverberation. In detail, the black keys f#2, g#2 and a#2 serve as first keys, and the first keys are used for selecting a reverberation environment. The black key f#2 represents a reverberation in an ordinary room, and the black keys g#2 and a#2 are representative of a reverberation in a small concert hall and a reverberation in a large concert hall.

On the other hand, the white keys f2, g2, a2 and b2 serve as second keys, and the second keys are used for selecting the depth of the reverberation. The white key f2 represents a shallow reverberation, and the white key b2 represents a deep reverberation. The other white keys g2 and a2 are used for intermediate reverberations, and the intermediate reverberation of the white key g2 is shallower than the intermediate reverberation of the white key a2.

Therefore, a combination of a black key and a white key determines a reverberation, and the selection of the reverberation is carried out when the electronic keyboard musical instrument is powered as will be described hereinlater.

Though not shown in FIG. 1, the white keys 3*a* assigned the notes f1, a1 and b1 serve as third keys, and are used for selecting a music reproduced in the automatic playing mode. The black keys 3*b* assigned the notes f#1, g#1 and a#1 serve as fourth keys, and are used for selecting a tempo in the automatic playing mode.

The switch board 4 has various switches, and a player selects a timbre of musical tones, a volume, effects imparted to the musical tones and a change of tone through the switches on the switch board 4. The switch board 4 further has a switch causing the electronic keyboard musical instrument to enter into the recording mode, and a performance through the fingering on the keyboard 3 is recorded in a memory. Some switches are assigned to the automatic playing mode, and a person instructs a start and a stop of automatic performance to the electronic keyboard musical instrument through these switches.

Of course, if only piano-like tones are produced by the electronic keyboard musical instrument, the switch board 4 becomes simpler than the above described arrangement.

Figure 2:
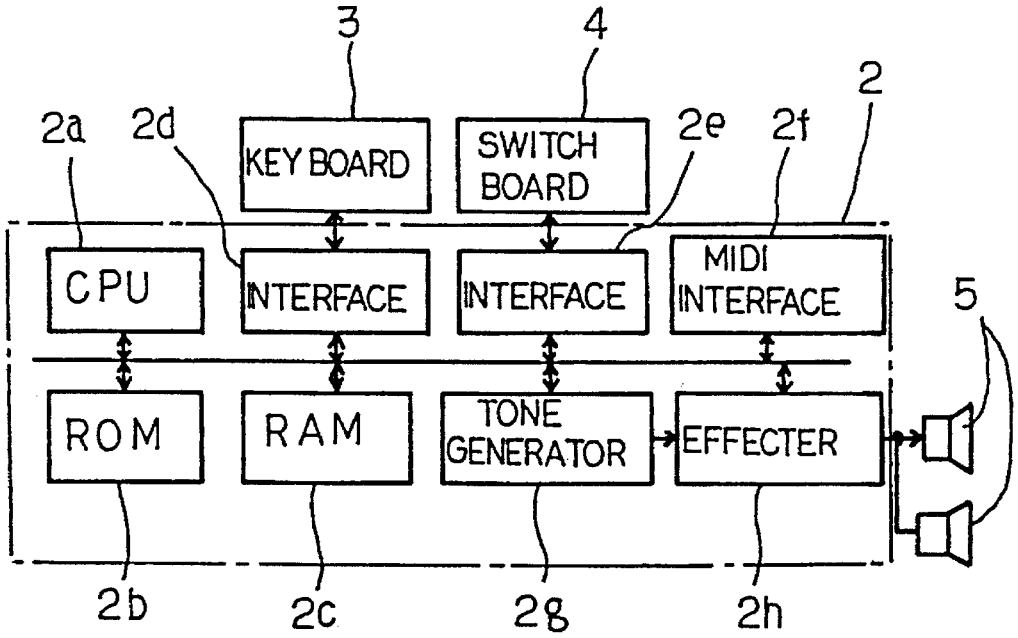
FIG. 2 is a block diagram showing the arrangement of an electronic system incorporated in the electronic keyboard musical instrument.
Figure 3:
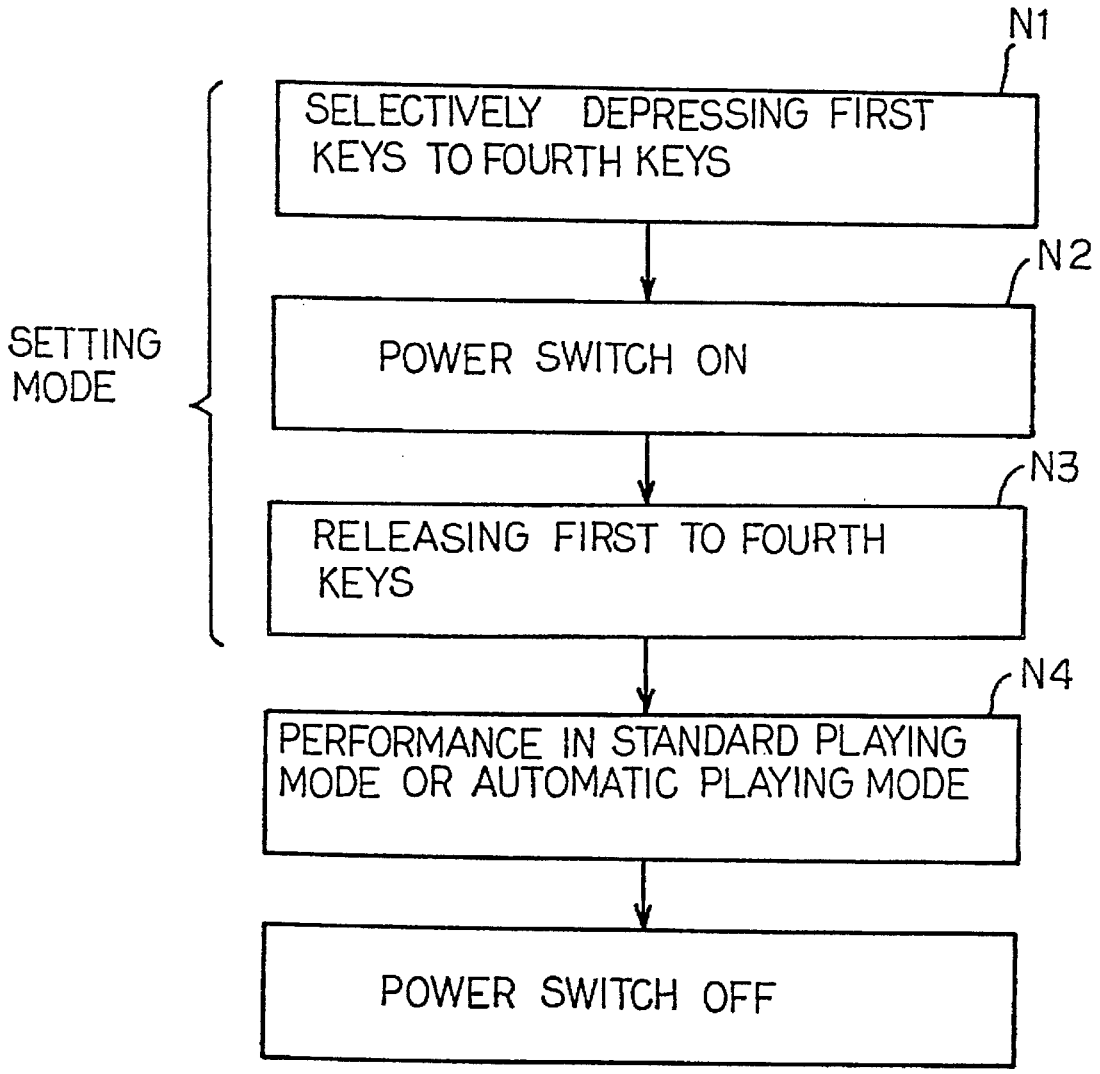
FIG. 3 is a flowchart showing a sequential selection made by a player.

As shown in FIG. 2, the circuit board 2 mounts a central processing unit 2*a*, a read only memory 2*b* abbreviated as "ROM", a random access memory device 2*c* abbreviated as "RAM", an interface 2*d* coupled to the keyboard 3, an interface 2*e* coupled to the switch board 4, an interface 2 for MIDI (Musical Instrument Digital Interface) codes, a tone generator 2*g* and an effecter 2*h*.

In the standard playing mode, the central processing unit 2*a* fetches key data codes stored in a resistor incorporated in the interface 2*d*, and processes the key data codes for producing music tone parameters. The music tone parameters are indicative pieces of information such as, for example, a note name, a key touch and a key event. The music tone parameters are supplied to the tone generator 2*g*, and the tone generator tailors a tone signal from the music tone parameters. Thereafter, the central processing unit erases the key data stored in the register.

Similarly, the central processing unit 2*a* fetches switch data codes in the standard playing mode, and produces effect parameters from the switch data codes for controlling music tones. The effect parameters are indicative of pieces of information such as, for example, a volume, a change of timbre and a change of tone, and are transferred to the effecter 2*h*. The effecter 2*h* modifies the music tone signal by the effect parameters.

Moreover, when the electronic keyboard musical instrument is powered under depressing one of the first and second keys, the central processing unit 2*a* enters into the setting mode, and fetches key data codes each indicative of key-event, i.e., key-on/key-off and a note assigned to the depressed or released key. The central processing unit 2*a* sequentially discriminates the depressed black key and the depressed white key, and determines the reverberation environment and the depth of the reverberation. The central processing unit produce reverberation parameters indicative of the selected reverberation environment and the selected depth, and supplies the reverberation parameters to the effecter 2*h*.

The read only memory device 2*b* stores instruction codes for program sequences executed in the standard playing mode, the setting mode, the automatic playing mode and the selecting mode. The central processing unit 2*a* sequentially fetches the instruction codes, and achieves the above described tasks. The random access memory device 2*c* provides temporary data storage, and the central processing unit 2*a* frequently communicates with the random access memory device 2*c* for storing the key data codes, the switch data codes and calculation results produced in the program sequences.

The read only memory device 2*b* further stores a plurality of sets of music tone parameters and effect parameters for built-in music scores, and the central processing unit 2*a* sequentially fetches the music tone parameters/the effect parameters in the automatic playing mode for reproducing a selected music.

The tone generator 2*g* tailors the music tone signal on the basis of the music tone parameters supplied from the central processing unit 2*a*. The music tone signal is supplied from the tone generator 2*g* to the effecter 2*h*, and is modified by using the effect parameters and the reverberation parameters. The music tone signal thus modified is supplied from the effecter 2*h* to the speaker system 5 and/or the headphone (not shown). The speaker system 5 imparts a stereophony to the electronic sounds.

The MIDI interface 2*f* encodes the music tone parameters and the effect parameters in accordance with the MIDI standards, and supplies the MIDI codes through the socket 6*a* to the outside thereof.

In operation, assuming now that a player wants to change a reverberation for the standard playing mode and/or a selected music and a selected tempo, the player depresses one of the first keys f#2, g#2, a#2 and a#2 and one of the second keys f2, g2, a2 and b2 for instructing the reverberation to the electronic keyboard musical instrument, and depresses one of the third keys f1, a1 and b1 and one the fourth keys f#1, g#1 and a#1 for selecting a music reproduced at a selected tempo in the automatic playing mode as by step N1.

Subsequently, the player depresses the power switch under depressing the selected keys as by step N2, and the electronic keyboard musical instrument enters into the setting mode. The central processing unit 2*a* fetches the key data codes in the interface 2*d*, and waits for releasing the keys. When the player releases the first to fourth keys, the central processing unit 2*a* acknowledges the selections, and produces the reverberation parameters.

Thus, the player makes a selection four times, i.e., the selection of the reverberation environment, the selection of the depth, the music to be reproduced in the automatic playing mode and the tempo for the selected music. In this instance, the selection of reverberation environment and the selection of the depth are a first selection and a second selection. Otherwise, the selection of the music and the selection of the tempo may be the first selection and the second selection instead of the selections of the reverberation.

When the electronic keyboard musical instrument exits from the setting mode, the electronic keyboard musical instrument automatically enters into the standard playing mode, and the player can perform a music through fingerings on the keyboard 3 as by step N4.

If the player manipulates-the start switch, the electronic keyboard musical instrument enters into the automatic playing mode, and reproduces the selected music at the selected tempo as by step N4. When the player changes the power switch off, the electronic keyboard musical instrument terminates all of the sequences.

Description is hereinbelow made on the program sequences executed by the central processing unit 2*a* with reference to FIGS. 4 to 6 of the drawings. When the player changes the power switch on, the central processing unit starts a main routine program illustrated in FIG. 4, and firstly initializes the system, and a selection flag KF is reset to zero as by step P1. The central processing unit 2*a* proceeds to step P2 for a keyboard sub-routine program. The central processing unit 2*a* changes the reverberation parameters from default values to selected values through the first and second selecting sub-routine.

Figure 5:
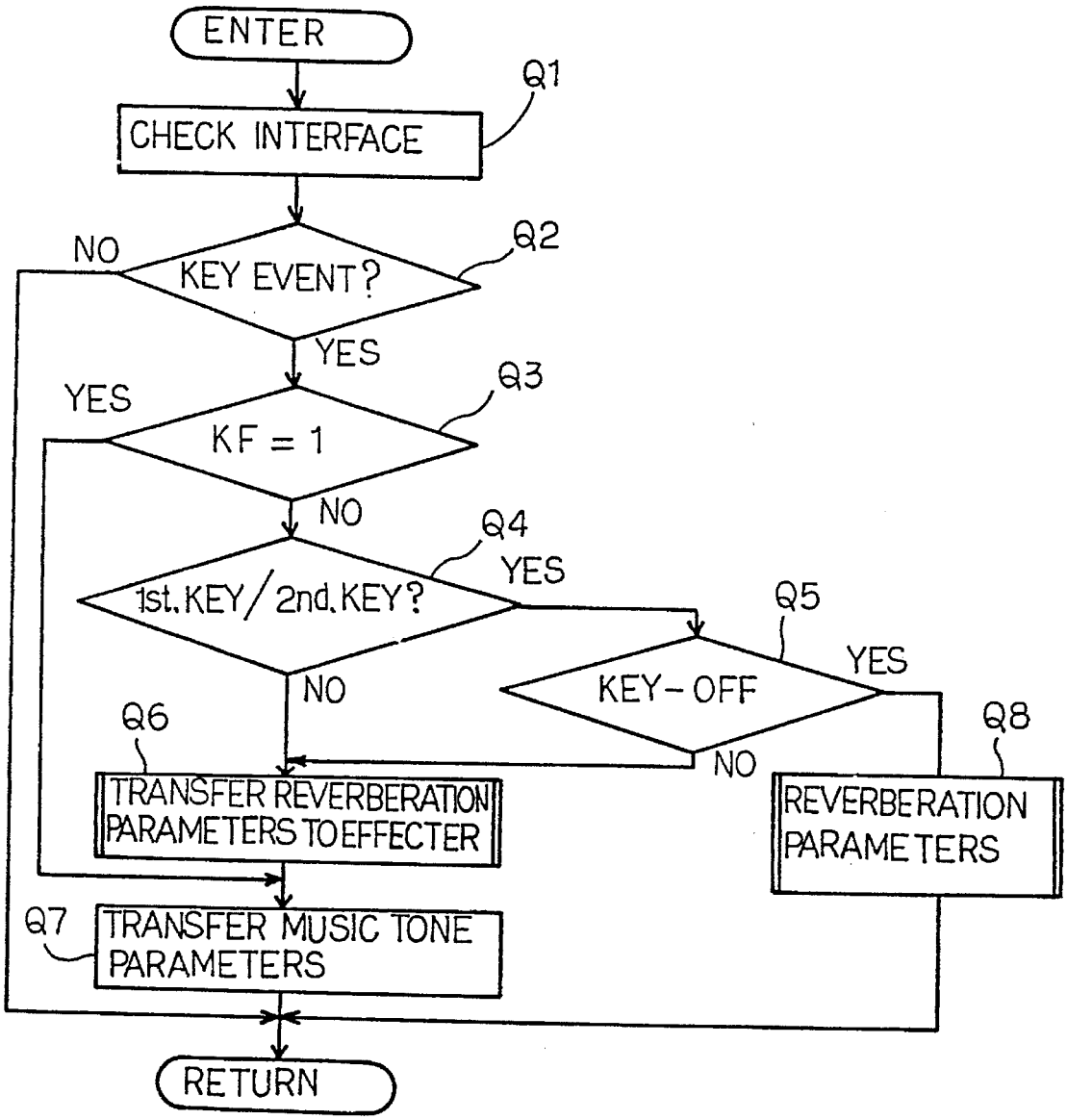
FIG. 5 is a flowchart showing a keyboard sub-routine program executed by the central processing unit.

The first and second selecting sub-routine program is illustrated in detail in FIG. 5, and the central processing unit 2*a* checks the interface 2*d* as by step Q1. The central processing unit 2*a* determines whether or not a key event takes place as by step Q2.

If the answer at step Q2 is given negative, the central processing unit 2*a* immediately returns to the main routine program. On the other hand, if the keys are depressed, the answer at step Q2 is given affirmative, and the central processing unit 2*a* proceeds to step Q3 to see whether or not the selecting flag KF is set to "1". Immediately after the power-on, the selecting flag KF is initialized to zero (see step P1), and the answer at step Q3 is given negative.

The central processing unit 2*a* proceeds to step Q4, and checks the depressed keys to see whether or not the depressed keys are the first key and the second key. If the answer at step Q4 is given affirmative, the central processing unit 2*a* proceeds to step Q5, and checks the interface 2*d* to see whether or not the player releases the depressed first and second keys. While the player is depressing the first and second keys, the answer at step Q5 is given negative, and the central processing unit 2*a* returns through steps Q6 and Q7 to the main routine program.

When the player releases the depressed first and second keys, the answer at step Q5 is changed to affirmative, and the central processing unit 2*a* produces the reverberation parameters on the basis of the depressed first and second keys as by step Q8. The central processing unit 2*a* stores the reverberation parameters indicative of the reverberation emvironment and the reverberation parameters indicative of the depth of the reverberation in registers RT and RD, and returns to the main routine program.

As described hereinbelow, the selecting flag KF is set to "1" in step Q6, and the electronic keyboard musical instrument becomes ready for a performance in the standard/automatic playing mode. For this reason, the answer at step Q3 is, thereafter, given affirmative, and the central processing unit 2*a* directly proceeds to step Q7 for transferring the music tone parameters and the effect parameters to the tone generator 2*g* and the effecter 2*h*, respectively. While the player is performing a music in the standard playing mode, the central processing unit 2*a* periodically executes steps Q1, Q2, Q3 and Q7 in the keyboard sub-routine program P2 for producing the electronic sounds, and returns to the main routine program.

Figure 6:
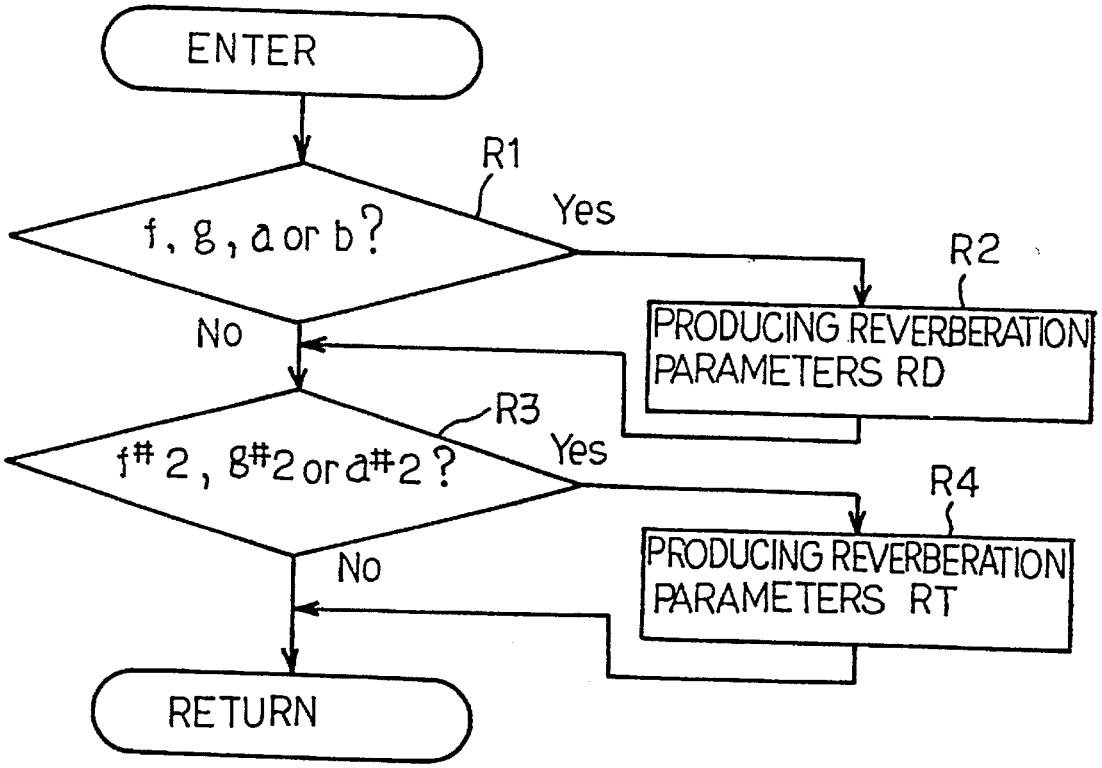
FIG. 6 is a flowchart showing a reverberation parameter producing sub-routine program executed by the central processing unit.

The program sequence for the generation of the reverberation parameters is illustrated in detail in FIG. 6. When the central processing unit 2*a* acknowledges the release of the depressed first and second keys, the answer step Q5 is changed to "YES", and the central processing unit enters into a reverberation parameters producing sub-routine program. The central processing unit 2*a* firstly checks the released keys to see which second key is depressed by the player as by step R1. When the central processing unit 2*a* produces the reverberation parameters RD indicative of the depth of the reverberation as by step R2, and proceeds to step R3. At step R3, the central processing unit 2*a* checks the released keys again to see which first key is depressed by the player, and produces the reverberation parameters RT indicative of the reverberation environment as by step R4.

If the answer at step R1 is given negative, the player still depresses one of the second keys, and the central processing unit 2*a* proceeds to step R3 without execution of step R2. If the depressed key is neither first key nor second key, the central processing unit 2*a* bypasses steps R2 and R4, and returns to step Q6 for transferring the contents of the registers RT and RD.

Figure 7:
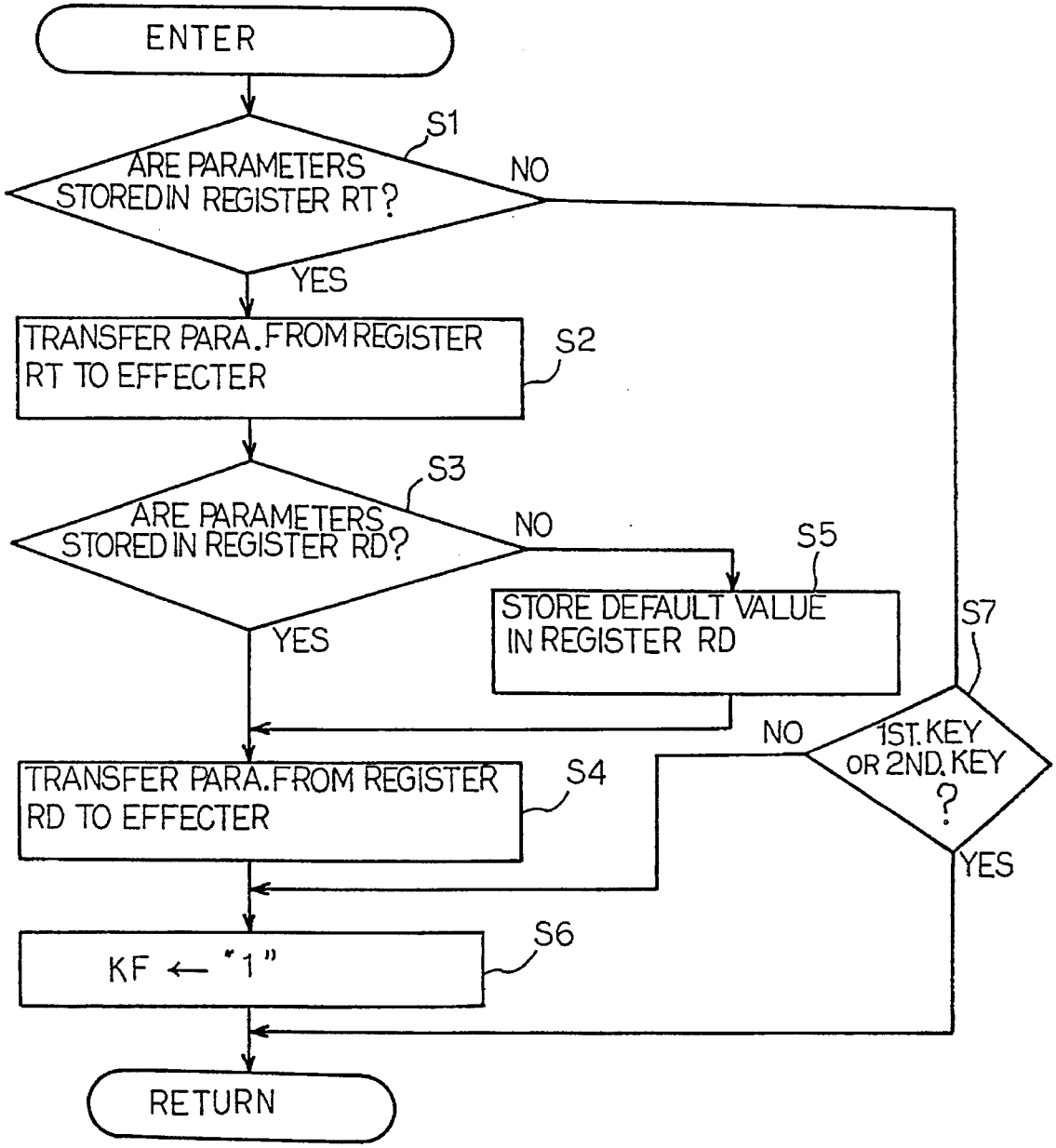
FIG. 7 is a flowchart showing a parameter transferring sub-routine program executed by the central processing unit.
Figure 9:
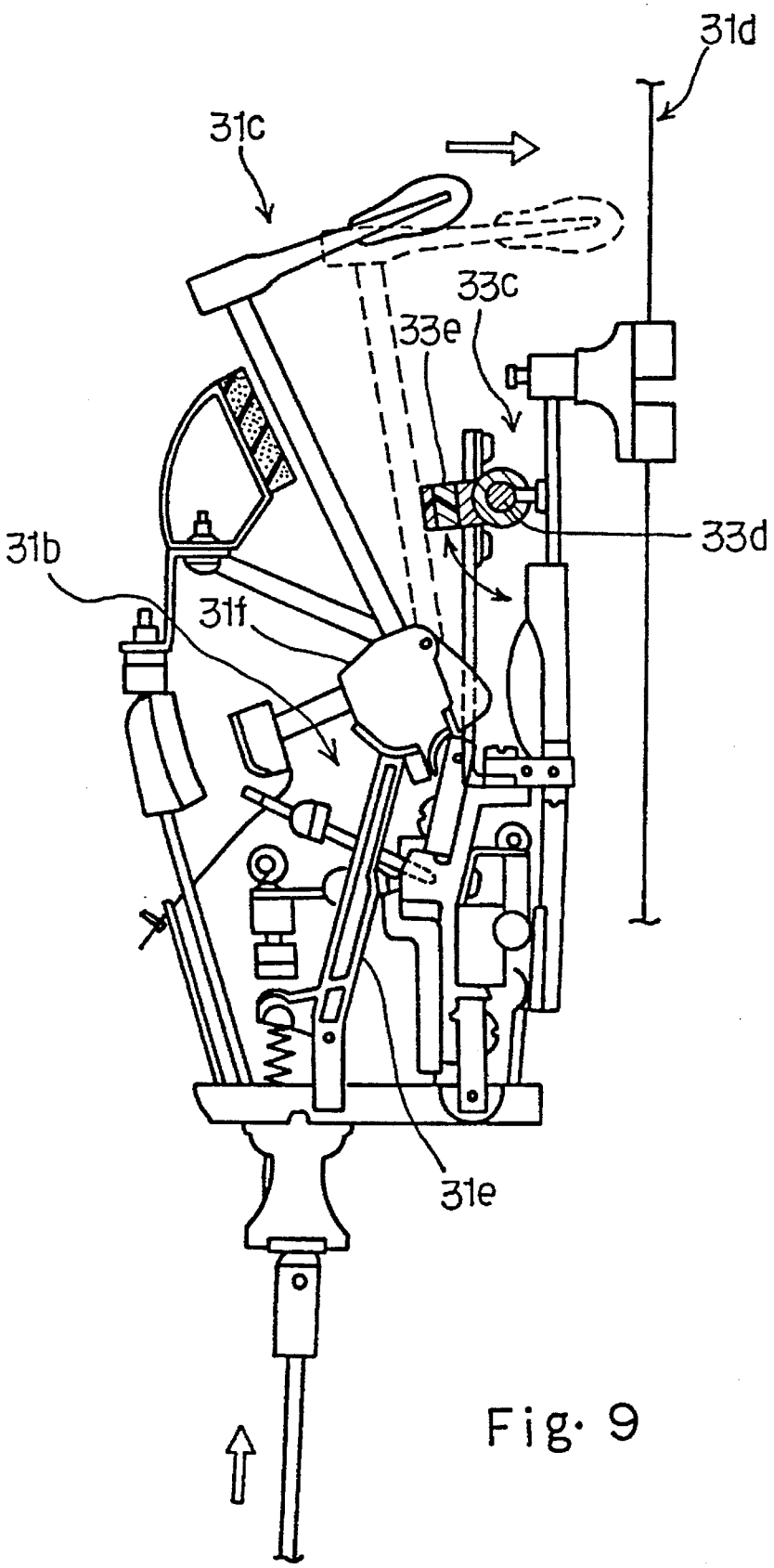
FIG. 9 is a side view showing key action mechanisms, hammer assemblies, sets of music wires and a hammer stopper incorporated in the composite keyboard music instrument.

At step Q6, the reverberation parameters changed at steps Q8 are transferred to the effecter 2*h*, and FIG. 7 illustrates the reverberation parameter transfer sub-routine program. First, the central processing unit checks the register RT to see whether or not the parameters are indicative of one of the three environments as by step S1.

If the player depresses a key except for the first and second keys after the execution of step Q8, the answer at step S1 is given affirmative, and the central processing unit 2*a* transfers the reverberation parameters from the register RT to the effecter 2*h* as by step S2. The central processing unit 2*a* further checks the register RD to see whether or not the player selects the depth of the reverberation as by step S3. If the answer at step S3 is given affirmative, the central processing unit 2*a* proceeds to step S4, and transfers the reverberation parameters indicative of the depth from the register RD to the effecter 2*h*. However, if the player only selects the reverberation emvironment, the answer at step S3 is given negative, and the central processing unit 2*a* writes a default value in the register RD as by step S5. Thereafter, the central processing unit 2*a* proceeds to step S4, and transfers the reverberation parameters indicative of the standard depth to the effecter 2*h*.

After the transmission of the reverberation parameters, the central processing unit 2*a* sets the selecting flag KF to "1" as by step S6, and returns to the keyboard sub-routine program.

On the other hand, while the player is still depressing the first and second keys, the answer at step Q5 is given negative, and the answer at step S1 is also given negative. Then, the central processing unit 2*a* proceeds to step S7, and checks the depressed key or keys whether or not the player wants to selects the reverberation environment. The answer at step S6 is given affirmative, and the central processing unit 2*a* returns to the keyboard sub-routine program without execution of step S6.

However, when the player starts a music without setting the reverberation emvironment, the answer at step Q4 is given negative, the answer at step S1 is given negative, and the answer at step S7 is also given negative. Then, the central processing unit 2*a* proceeds to step S6, and sets the selecting flag KF to "1", and returns to the keyboard sub-routine program. After the set of the selecting flag KF to "1", the central processing unit 2*a* bypasses steps Q4, Q5, Q6 and Q8 in the keyboard sub-routine program, and directly proceeds from step Q3 to step Q7. This means that the electronic keyboard musical instrument is changed from the setting mode to the standard playing mode.

At step Q7, the central processing unit 2*a* transfers the music tone parameters to the tone generator 2*g*, and the effect parameters are transferred to the effecter at step P4 as will be described hereinbelow. While the player is performing a music, the central processing unit 2*a* sequentially transfers the music tone parameters to the tone generator 2*g* for producing music tone signal, and the effecter 2*h* imparts the selected reverberation and other effects to the electronic sounds.

In this instance, the interface 2*d*, the power switch on the switch board 4, the interface 2*e*, the flag KF, the central processing unit 2*a* and steps P1, Q2 and Q3 as a whole serve as an entry means. The interface 2*d*, the central processing unit 2*a* and steps Q4, Q5 and R3 and R4 as a whole constitute a first selecting means, and the interface 2*d*, the central processing unit 2*a* and steps Q4, Q5 and R1 and R2 as a whole constitute a second selecting means. The central processing unit 2*a*, the flag KF and steps S6 and Q3 form in combination an exit means, and the effecter 2*h*, the central processing unit 2*a* and steps S2 and S4 as a whole constitute a modifying means.

Figure 4:
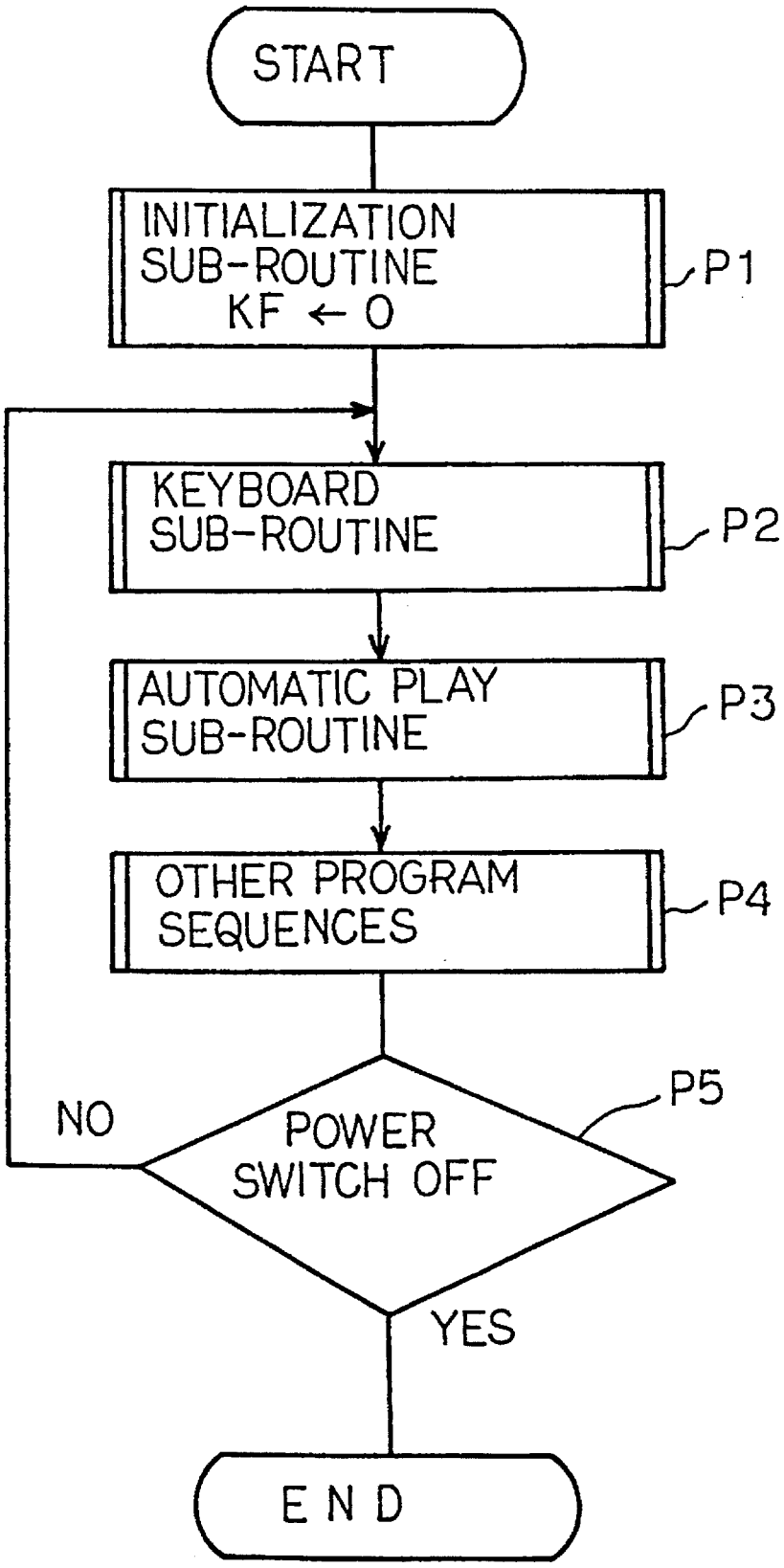
FIG. 4 is a flowchart showing a main routine program executed by a central processing unit incorporated in said electronic system.

Turning to FIG. 4 of the drawings, when the central processing unit 2*a* exits from the keyboard sub-routine P2, the automatic play sub-routine program is executed by the central processing unit 2*a*. In the automatic play sub-routine program, the central processing unit 2*a* discriminates one of the selected third keys f1, a1 and b1 indicative of a music selected by the player and one of the selected fourth keys f#1, g#1 and a#1 indicative of a tempo for the selected music. The selecting sequence is similar to that of the selection for the reverberation shown in FIGS. 5 to 7, and is not illustrated in the drawings.

When the player depresses a start switch on the switch board 4, the central processing unit 2*a* sequentially fetches the music tone parameters and the effect parameters stored in the read only memory device, and supplies the music tone parameters and the effect parameters to the tone generator 2*g* and the effecter 2*h*. The tone generator 2*g* produces the music tone signal from the music tone parameters, and the effecter 2*h* modifies the music tone signal in accordance with the effect parameters. The modified music tone signal is supplied to the speaker system 5, and the speaker system 5 reproduces the selected music at the selected tempo.

When the central processing unit 2*a* exits from the automatic play sub-routine program at step P3, the other program sequences are executed by the central processing unit as by step P4. One of the other program sequences is used for discriminating the manipulated switches on the switch board 4. If the player wants to impart an effect, he or she manipulates a switch assigned to the effect, and the central processing unit 2*a* determines the manipulated switch, and produces the effect parameters. The effect parameters are transferred to the effecter 2*h*.

When the central processing unit 2*a* executes the other program sequences, the central processing unit 2*a* proceeds to step P5 to see whether or not the player changes the power switch off. While the power switch is in on-state, the central processing unit 2*a* reiterates the loop consisting of steps P2 to P5, and allows the player to enjoy a music in the standard playing mode or the automatic playing mode.

If the player changes the power switch off, the answer at step P5 is given affirmative, and the electronic musical keyboard instrument terminates the operation.

As will be appreciated from the foregoing description, at least two selections are made on the keyboard, and the switch board 4 is simpler than that of the prior art electronic keyboard musical instrument.

Second Embodiment

Figure 8:
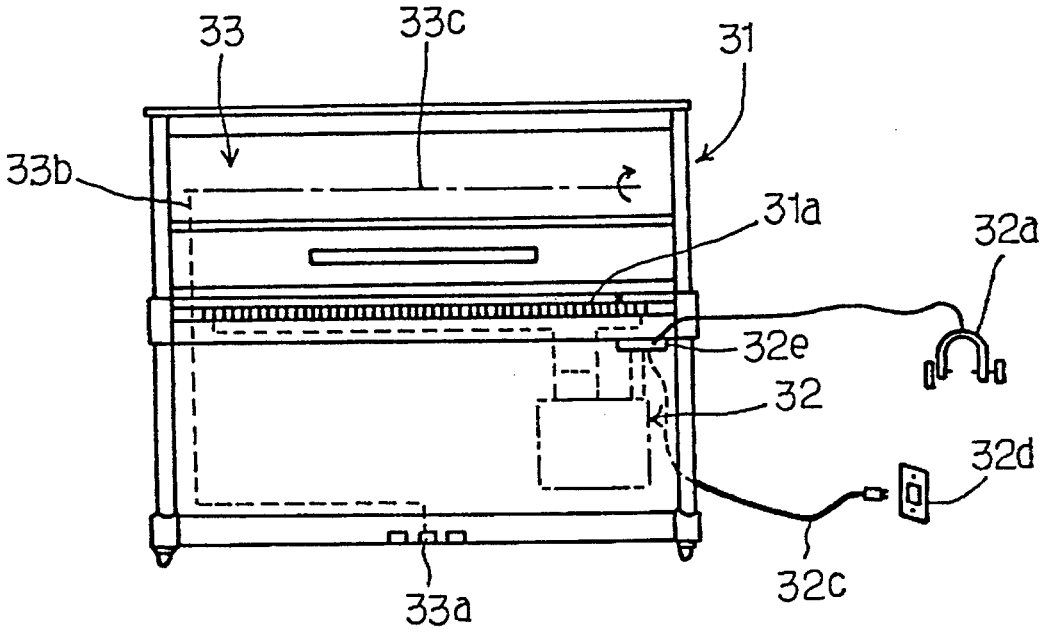
FIG. 8 is a front view showing a composite keyboard musical instrument according to the present invention.

Turning to FIG. 8 of the drawings, a composite keyboard musical instrument embodying the present invention largely comprises an upright piano 31, an electronic sound producing system 32 and a controlling system 33 for shifting the composite keyboard musical instrument between a silent mode, an acoustic sound mode and an automatic playing mode. While the composite keyboard musical instrument is staying in the acoustic sound mode, a player can perform a music through fingering on the keyboard 31*a* of the upright piano 31 as similar to a standard upright piano, and the upright piano produces acoustic sounds through vibrations of strings. On the other hand, while the composite keyboard musical instrument is staying in the silent mode, a shank stopper prevents the strings from impact of each hammer as will be described hereinlater, and the electronic sound producing system 32 produces electronic sounds through a headphone 32*a*. For this reason, the player enjoys the performance without acoustic sound in the silent mode.

The upright piano 31 is similar in structure to a standard upright piano, and comprises the keyboard 31*a*, a plurality of key action mechanisms 31*b* respectively associated with black and white keys of the keyboard 31*a*, a plurality of hammer assemblies 31*c* respectively driven by the key action mechanisms 31*b* and a plurality of sets of music wires 31*d* struck by the associated hammer assemblies 31*d* in the acoustic sound mode for producing the acoustic sounds. When a player depresses one of the black and white keys, the jack 31*e* of each key action mechanism 31*b* escapes from a butt 31*f* of the associated hammer assembly 31*c* in both acoustic sound and silent modes, and the player feels the piano touch at the escape of the jack 31*e*.

Figure 10:
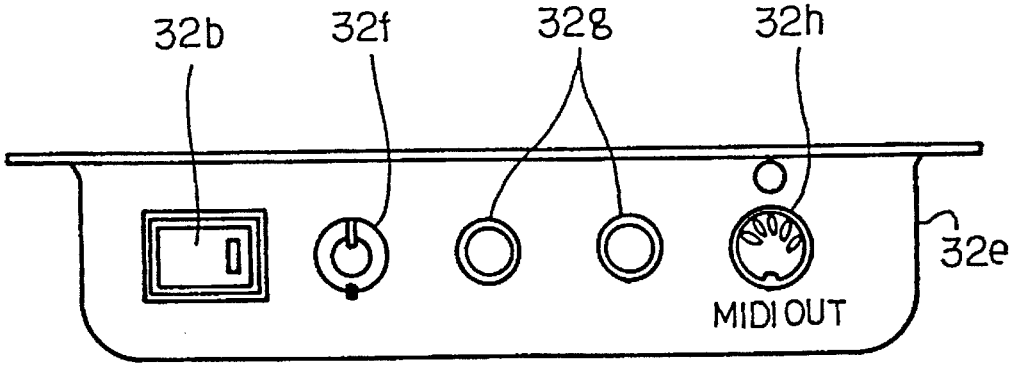
FIG. 10 is a front view showing a switch board incorporated in the composite keyboard musical instrument.

The electronic sound producing system 32 is connectable through a power switch 32*b* and a wire 32*b* to an electric power source 32*c*. The power switch 32*b* is provided on a switch board 32*e* together with a volume control switch 32*f*, a pair of jacks 32*g* for the headphone 32*a* and a MIDI output terminal 32*h* (see FIG. 10). These switches 32*b*, 32*f*, 32*g* and 32*h* form parts of the electronic sound producing system 32.

Though not shown in the drawings, the electronic sound producing system 32 has a tone generator, an effecter, read only memory, a random access memory and various processors, and these components produces a music tone signal and modifies it, if necessary.

Figure 11:
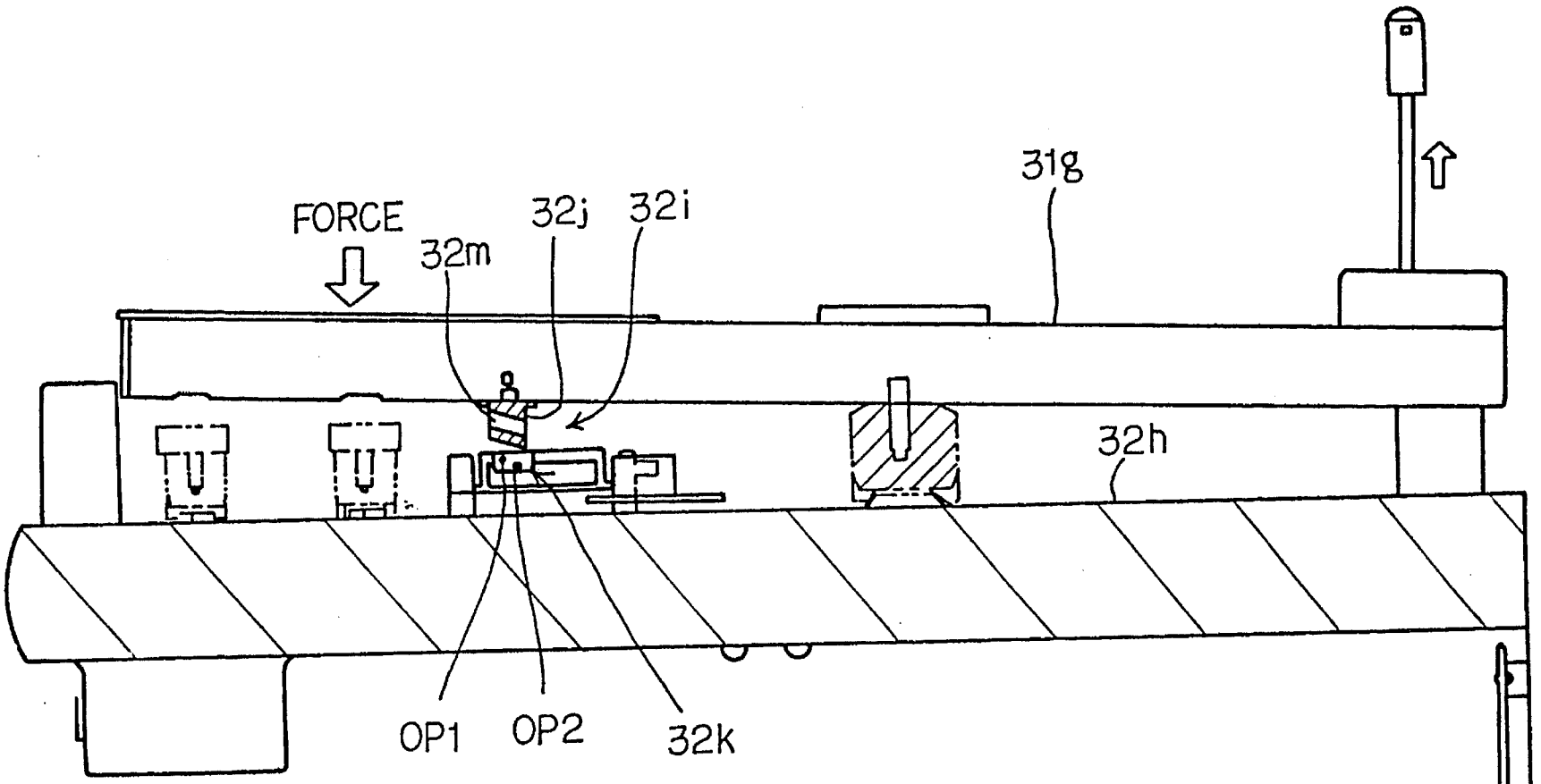
FIG. 11 is a side view showing a key sensor associated with a white key incorporated in the composite keyboard musical instrument.

As will be better seen from FIG. 11, a key sensor 32*i* is provided for each of the black and white keys 31*g*, and the key sensors 32*i* form parts of the electronic sound producing system 32. The key sensor 32*i* is implemented by a combination of a shutter plate 32*j* attached to the associated key 31*g* and two photo-couplers 32*k* mounted on a key bed 32*h*. The shutter plate 32*j* has a window 32*m* oblique to the bottom surface of the associated key 31*g* in the rest position, and photo-couplers 32*k* are different in height from the key bed 32*h*.

Figure 12:
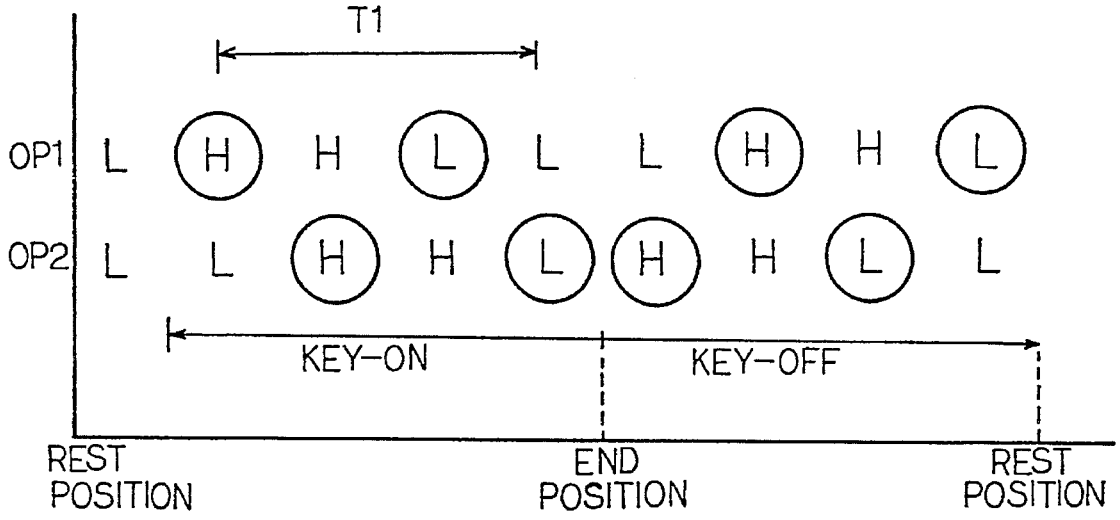
FIG. 12 is a view showing a two bit digital code output from the key sensor in terms of a position of the white key.

The two photo-couplers 32*j* radiate light beams OP1 and OP2, and the shutter plate 32*j* selectively interrupts and transfers the optical beams OP1 and OP2 during a reciprocal motion of the associated key 31*g*. The photo-couplers 32*k* changes the bit patters of the output signal as shown in FIG. 12. In FIG. 12, "L" is indicative of the transfer of the light beam without interruption, and "H" stands for an interruption with the shutter plate 32*j*. When the shutter plate 32*j* changes the status of the light beam OP1 or OP2, "H" and "L" are encircled in FIG. 12. The electronic sound producing system 32 monitors the two-bit code, and determines a key motion, i.e., a quick shallow repetition, a pianissimo touch and so fourth on the basis of the variation of the bit pattern in time period T. When the electronic sound producing system determines the key motion, the electronic sound producing system estimates loudness and a timing for generating the electronic sound with a note corresponding to that of the depressed key 31*g*.

Thus, the key sensors 32*i* determines a depressed key and the motion of the depressed key, and the electronic sound producing system 32 produces the electronic sound through the headphone as if the associated hammer strikes the set of strings.

The controlling system 33 comprises a pedal 33*a* provided between a soft pedal and a damper pedal, a link mechanism 33*b* converting the pedal motion into an angular motion and a shank stopper 33*c* rotatable by the link mechanism 33*b* (see FIG. 8). The shank stopper 33*c* has a rod member 33*d* driven for rotation by the link mechanism 33*b* and a cushion structure 33*e* supported by the rod member 33*d*.

While a player is performing a music in the acoustic sound mode, the pedal 33*a* is released, and the cushion structure 33*e* is directed downwardly. For this reason, the hammer assemblies 31*c* can strike the associated sets of strings without interruption of the cushion structure 33*e*. This position is referred to as "free position".

On the other hand, if the player wants to practice a music without acoustic sounds, he or she steps on the pedal 33*a*, and the pedal 33*a* is maintained in the position. As a result, the link mechanism 33*b* rotates the rod member 33*d*, and the cushion member 33*e* is opposed to the hammer shanks. This position is referred to as "blocking position". While the player is performing the music, the hammer assemblies 31*c* rebound on the cushion structure 33*e*, and never strike the associated sets of strings 31*d*. The key sensors 32*i* detects the key motions, and the electronic sound producing system 32 produces the electronic sounds through the headphone 32*a*.

The black and white keys assigned the notes f#2/g#2/a#2, f2/g2/a2/b2, f1/a1/b1 and f#1/g#1/a#1 respectively serve as first keys, second keys, third keys and fourth keys, and used for selecting a reverberation emvironment, a depth of reverberation, a music to be produced in an automatic playing mode and a tempo for the selected music. One of the processors executes the program sequences as similar to the central processing unit 2*a*, and selects the reverberation emvironment, the depth of reverberation for the electronic sounds. The processor further selects a music and the tempo for the selected music, and reproduces the music in the selected tempo.

Although particular embodiments of the present invention have been shown and described, it will be obvious to those skilled in the art that various changes and modifications may be made without departing from the spirit and scope of the present invention. For example, the acoustic piano may be a grand piano, and the electronic sound producing system may be replaceable with any kind of system in so far as a component modify the music tone signal. Moreover, the first selecting means and the second selecting means may make the first and second selections for any two attributes of an electronic sound or a performance.

What is claimed is:

1. A keyboard musical instrument having a standard playing mode for producing electronic sounds and a setting mode for making at least two selections regarding said electronic sounds, said keyboard musical instrument comprising:

a keyboard having a plurality of keys selectively operable by a player, said plurality of keys including a first set of keys and a second set of keys;

an electronic sound producing system which detects operation of said plurality of keys by said player in said standard playing mode for producing said electronic sounds;

a power switch for causing power to be supplied to said keyboard musical instrument;

entry means for causing said keyboard musical instrument to enter into said setting mode, when said power switch is turned on while at least one of said first set of keys and said second set of keys is depressed;

first selecting means for discriminating at least one depressed first key from said first set of keys in said setting mode for making a first selection for said electronic sounds;

second selecting means for discriminating at least one depressed second key from said second set of keys in said setting mode for making a second selection for said electronic sounds;

exit means for causing said keyboard musical instrument to return to said standard playing mode from said setting mode; and modifying means responsive to said first and second selections for modifying said electronic sounds in said standard playing mode.

2. The keyboard musical instrument as set forth in claim 1, in which said exit means returns said electronic keyboard musical instrument to said standard playing mode when each of said first set of keys and said second set of keys which were depressed when said power switch is turned on has been released.

3. The keyboard musical instrument as set forth in claim 1, further comprising:

an acoustic piano having said keyboard, a plurality of key action mechanisms linked with said plurality of keys, a plurality of hammer assemblies driven by said plurality of key action mechanisms, respectively and a plurality of sets of music wires each struck by one of said plurality of hammer assemblies for producing an acoustic sound when the associated key is depressed, and a controlling system having a stopper changed between a free position and a blocking position changed by said player, said hammer assemblies rebounding on said stopper in said blocking position before striking the associated sets of music wires, said stopper in said blocking position allowing said hammer assemblies to strike the associated sets of music wires.

* * * * *